US006905055B2

(12) United States Patent
Maier et al.

(10) Patent No.: US 6,905,055 B2
(45) Date of Patent: Jun. 14, 2005

(54) SETTING TOOL

(75) Inventors: Michael Maier, Rankweil (AT); Mario Scalet, Schaan (LI); Stefan Bonig, Wasserburg (DE)

(73) Assignee: Hilti Aktiengesellschaft, Schaan (LI)

( * ) Notice: Subject to any disclaimer, the term of this patent is extended or adjusted under 35 U.S.C. 154(b) by 53 days.

(21) Appl. No.: 10/696,302

(22) Filed: Oct. 27, 2003

(65) Prior Publication Data

US 2004/0134959 A1 Jul. 15, 2004

(30) Foreign Application Priority Data

Nov. 4, 2002 (DE) ..... 102 51 307

(51) Int. Cl.[7] ..... B25C 1/14
(52) U.S. Cl. ..... 227/10; 173/211
(58) Field of Search ..... 227/10, 11, 9, 227/130; 173/162.2, 210, 211

(56) References Cited

U.S. PATENT DOCUMENTS 3,556,379 A * 1/1971 Bayer et al. ..... 227/10
3,860,161 A * 1/1975 Engstrom et al. ..... 227/10
4,858,811 A * 8/1989 Brosius et al. ..... 227/10
5,114,064 A * 5/1992 Jochum et al. ..... 227/9
5,273,198 A * 12/1993 Popovich et al. ..... 227/10
5,653,370 A * 8/1997 Bereiter et al. ..... 227/10
5,884,828 A * 3/1999 Hirtl et al. ..... 227/10
5,992,723 A * 11/1999 Lee ..... 227/9
6,053,388 A * 4/2000 Pfister et al. ..... 227/10
6,126,055 A * 10/2000 Gantner et al. ..... 227/10

* cited by examiner

*Primary Examiner*—Scott A. Smith
(74) *Attorney, Agent, or Firm*—Sidley Austin Brown & Wood, LLP

(57) ABSTRACT

A combustion-engined setting tool, including a housing (11), an axially displaceable piston guide (13) and a firing pin guide (12) provided on a side of the piston guide (13) facing in the direction opposite the setting direction and axially displaceable relative to the housing (11), damping element (20) supported against a stop (17) provided in the housing (11) and cooperating with the firing pin guide (12), and a locking device (30) having a locking position (28) in which it prevents a press-on force, which is generated upon the setting tool (10) being pressed against a construction component, from acting on the damping element (20), so that the damping element (20) remains inactive during a press-on process, and having a release position (29) in which the damping element (20) becomes active and is capable of absorbing recoil forces.

12 Claims, 9 Drawing Sheets

SETTING TOOL

BACKGROUND OF THE INVENTION

1. Field of the Invention

The present invention relates to a setting tool including a housing, a piston guide located in the housing and axially displaceable relative thereto in a direction opposite a setting direction against a biasing force of a spring, a firing pin guide provided on a side of the piston guide facing in the direction opposite the setting direction and axially displaceable relative to the housing, and a damping element supported against a stop provided in the housing and cooperating with the firing pin guide for absorbing recoil forces during a setting process.

2. Description of the Prior Art

Setting tools of the type described above can be driven by solid, gaseous, or liquid fuels. In setting tools, the drive or setting piston is driven by combustion gases. The setting piston drives fastening elements in constructional components.

German Publication DE 195 44 105 A1 discloses a setting tool having a piston guide and a firing pin guide both arranged in the tool housing and axially displaceable relative to the housing against the force applied by a damping element supported in the housing.

The drawback of the known setting tool, in which the damping element is arranged in the press-on chain of the setting tool, consists in that the damping elements becomes compressed or upset to a certain degree already upon pressing of the setting tool against a constructional component. Therefore, the tool user senses, during the press-on step, a "light" stop, and the damping element cannot completely dampen any more recoil forces generated during a setting process.

Accordingly, an object to the present invention is to provide a setting tool of the type described above and in which the above-mentioned drawback is eliminated.

SUMMARY OF THE INVENTION

This and other objects of the present invention, which will become apparent hereinafter, are achieved by providing, in a setting tool, a locking device having a locking position in which it prevents a press-on force, which is generated upon the setting tool being pressed against a construction component, from acting on the damping element, whereby the damping element remains inactive during a press-on process, and having a release position to which the locking device is displaced upon actuation of a switch for actuating a setting process and in which the damping element becomes active and is capable of absorbing the recoil forces.

The particularity of the present invention consists in that a locking device is provided between the housing and the piston guide and/or the firing pin guide and which includes a plurality of locking elements which prevent transmission of a force to the damping element in the locking position of the locking device when the tool is pressed against a constructional component, and which allows a force to be transmitted to the damping element upon actuation of switching means that provides for displacement of the locking device to its release position. The locking device also permits to prevent the damping element from forming part of the press-on chain. This is because the locking device forms a bridge between the damping element and the movable piston and firing pin guides. After the locking device has been displaced in its release position, the entire damping path of the damping element becomes available for absorbing the recoil torque or the recoil pulse. Further, a user of the setting tool, upon pressing the tool against a constructional component, is able to detect a noticeable stop, which indicates to him that the tool has been completely pressed against the constructional component.

According to an advantageous embodiment of the present invention, the locking device has at least two locking elements which are brought in a stop relationship with each other in the locking position of the locking device and are displaced relative to each other in the release position of the locking device so that no bridging of the two elements exist, and the two elements can be displaced past each other.

Advantageously, one of the locking elements is formed as a stop which the other locking element that, e.g., is formed as a pivotal servo component, abuts in the locking position of the locking device. However, one of the locking elements can be translationally displaced. For bridging a larger displacement path, advantageously, a third locking element, which is formed as a stop securable to the housing, is provided. The first, second and third locking elements can form a continuous chain that would bridge the damping element in the locking position of the locking device. Advantageously, at least one locking element or locking member can be displaced, upon actuation of the setting process-actuating switch from its locking position, in which it abuts a stop, to its release position.

Advantageously, the switching means or the actuation switch is also connected with the ignition unit, so that the displacement of the locking device from its locking position to its release position takes place simultaneously with ignition of the propellant in the setting tool.

According to a further advantageous embodiment of the present invention, the locking device has a blocking member pivotally supported in the housing and formed as a pivotal lever, and a stop provided on the firing pin guide and which the blocking member engages in the locking position of the locking device. Instead of the firing pin guide, the stop can be provided on any other type of the ignition unit that is directly supported against the tool housing by a damping element. The blocking member engages the stop, which is provided on the firing pin guide or any other ignition unit, in its blocking position.

Advantageously, the blocking member is displaced from its blocking position behind the stop in its release position, in which it does not extend into the displacement path of the firing pin guide or the ignition unit, by an appropriate switch element, e.g., an actuation switch. For displacing the blocking member from its release position to its blocking position, there is provided a reset element that, e.g., can be arranged on the piston guide.

The reset element displaces the blocking member, with a suitable entrain member, from its release position to its blocking position when the piston guide returns to its initial position behind the stop on the firing pin guide or the ignition unit, upon lifting of the setting tool off the constructional component.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments when read with reference to the accompanying drawings.

BRIEF DESCRIPTION OF THE DRAWINGS

The drawings show:

FIG. 7 a cross-sectional longitudinal view of the second embodiment of the setting tool according to the present invention in an inoperative position thereof;

FIG. 7*a* a side view of a part of a locking device according to the present invention used in the setting tool shown in FIG. 7;

DETAILED DESCRIPTION OF THE PREFERRED EMBODIMENTS

Figure 1:
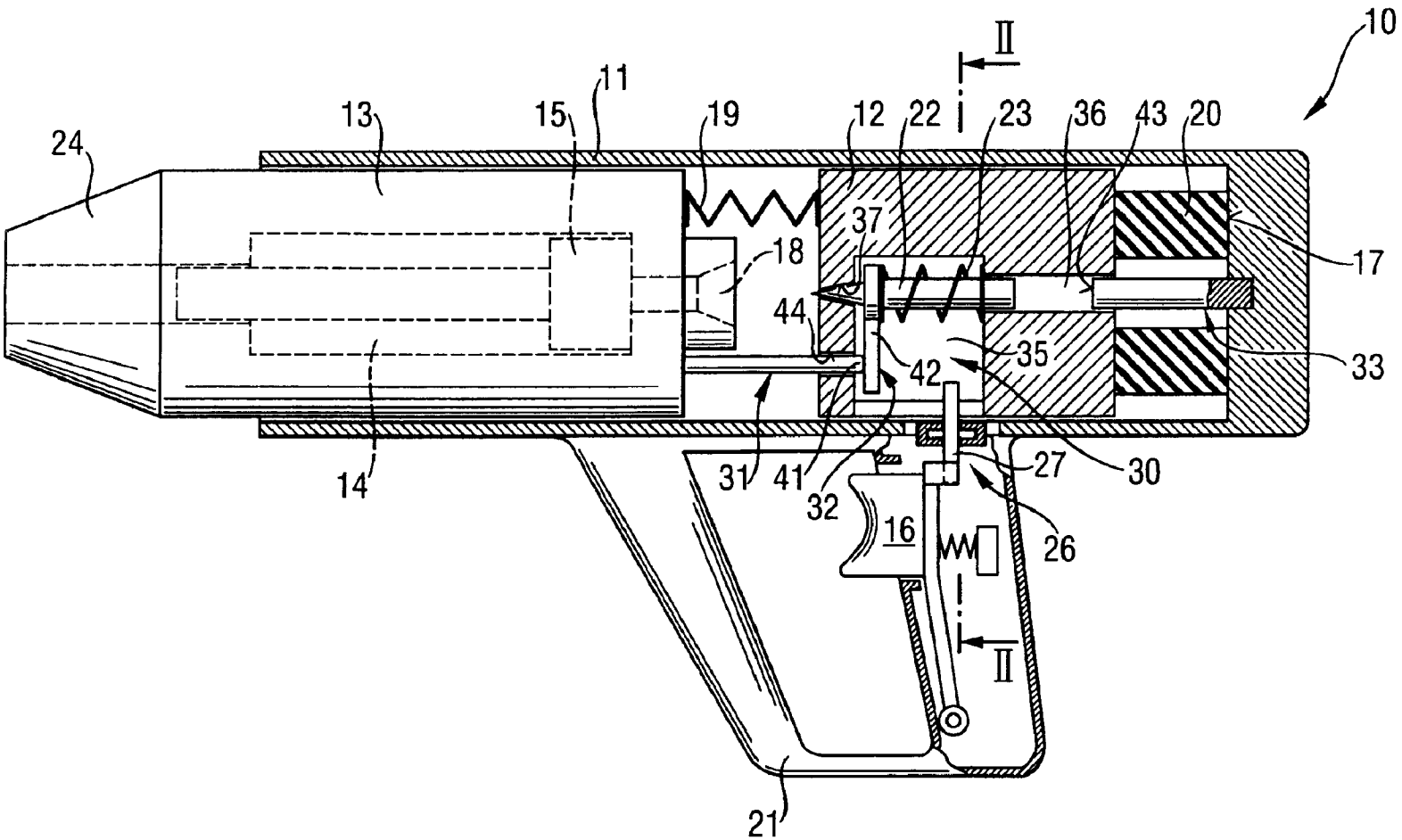
FIG. 1 a cross-sectional longitudinal view of the first embodiment of the setting tool according to the present invention in an inoperative position thereof, FIG. 2 a cross-sectional view of along line II—II the setting tool shown in FIG. 1.
Figure 2:
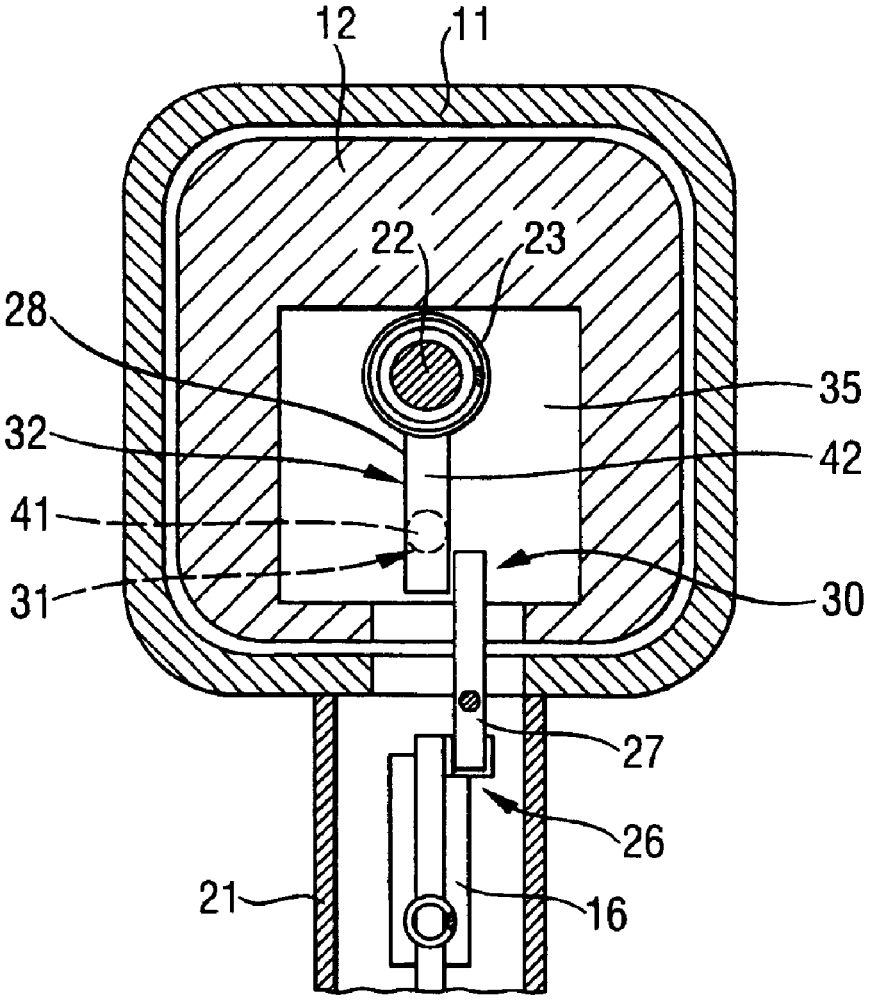

A combustion-engined setting tool 10 according to the present invention, a first embodiment of which is shown in FIGS. 1–6, includes a one-part or multi-part housing 11 and a piston guide 13 which is arranged in the housing 11. A piston 15 is displaceably arranged in a hollow chamber 14 of the piston guide 13. The piston 15 is driven by a propellant or by products of its reaction such as, e.g., combustion gases, etc. . . . A handle 21, which is provided on the housing 11, carries an actuation switch 16 with which a user of the setting tool 10 initiates a setting process. In the embodiment shown in FIGS. 1–6, the piston guide 13 is displaceably supported in the sleeve-shaped housing 11. The piston guide 13 is resiliently supported, by a spring 19, against a firing pin guide 12 which is likewise arranged in the sleeve-shaped housing 11. The firing pin guide 12 is located farther in the interior of the housing 11 and is supported against a damping element 20 which is supported against a stop 17 provided on an inner wall of the housing 11. The damping element 20 is formed as an elastic annular ring. Other designs of the damping element can also be used, e.g., the damping element can be formed as a hydraulic shock absorber that can also be combined with a spring element.

The spring 19 can be formed e.g., as a compression spring that pushes the piston guide 13 out of the housing 11 to a stop when the setting tool 10 is not pressed against a constructional component. The extended position of the piston guide 13 is shown in FIG. 1. A setting process with the setting tool 10 is only then possible when the setting tool is pressed against a constructional component with a bolt guide 24 that is located downstream of the piston guide 13 in the setting direction. It should be pointed out that the bolt guide can also be made displaceable relative to the piston guide.

On the piston guide 13, there is provided a cartridge chamber 18 in which a propellant can be received (not shown in the drawing). The propellant can be provided in form of cartridges, pellets and the like which can be located in a magazine strip.

The setting tool 10 further includes a locking device 30 that mechanically bridges over the damping element 20 with the constructional component during the press-on process so that the damping element is not subjected to a load. However, upon initiation of a setting process with the actuation switch 16, the bridge-over is lifted so that the damping element 20 is able to absorb the recoil force. The structure and operation of the locking device 30 will be explained in more detail further below.

The firing pin guide 12 has a hollow chamber 35 which is adjoined, in a direction opposite the setting direction, by a channel 36 in which a firing pin 22 is displaceably arranged. The channel 36 opens in the interior of the housing 11. When the setting tool 10 is pressed against a constructional component, the firing pin 22 acts, through a conical opening 37 facing the cartridge chamber 18, on a propellant located therein. In the rear wall of the housing 11, there is supported a locking element 33 of the device 30 and which is formed as an elongate pin. The locking element 33 is arranged coaxially with the channel 36. The locking element 33 forms a housing-side stop 43 for the firing pin 22 that carries, in its front region, a further locking element 32 of the locking device 30. The locking element 32 is formed as a blocking member 42. The firing pin 22 is fixedly connected with the locking element 32 and is pivotally guided therewith in the firing pin guide 12. A spring 23 biases the firing pin 22 in the direction toward the opening 37 so that the firing pin 22 and the locking element 32 reach the opening 37 and are located shortly before it (the locking element 32) in the non-operative position of the setting tool 10 (shown in FIGS. 1–2).

Figure 3:
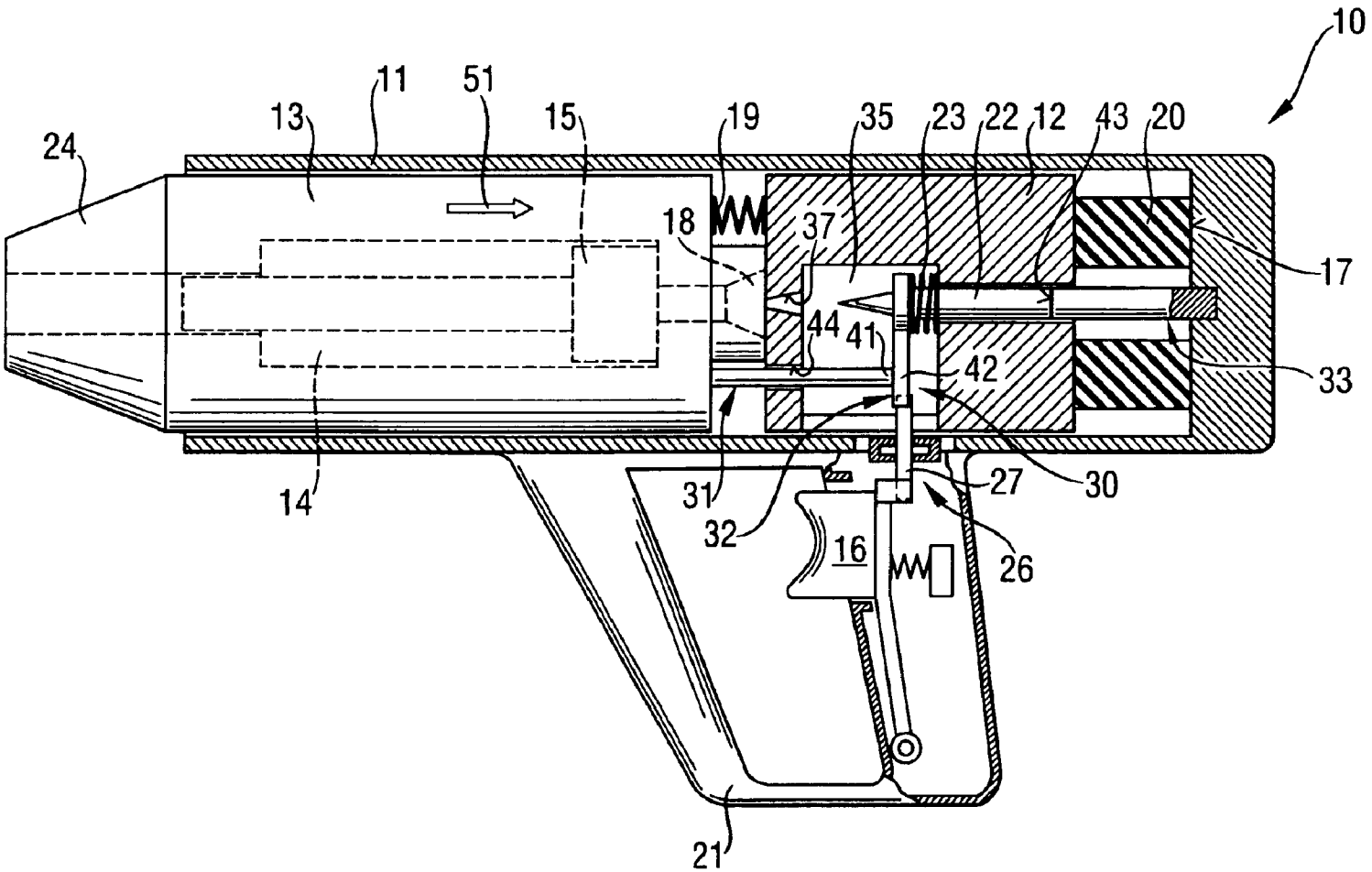
FIG. 3 a cross-sectional longitudinal view of the setting tool shown in FIG. 1 in its press-on position.

A further locking element 31 is provided on the piston guide 13. The locking element 31 also forms part of the locking device 30 and forms a stop 41 for the locking element 32 (the blocking member 42). The locking element 31 is formed as an elongate pin. In the non-operative or initial position of the setting tool 10 shown in FIGS. 1–2, the pin-shaped locking element 31, together with the stop 41, extends through an opening 44 into the hollow chamber 35, with the stop 41 being located in front of the blocking member 42. When the setting tool 10 is pressed against a constructional component (not shown), the piston guide 13 is displaced against the biasing force of the spring 19 in the direction 51 into the interior of the housing 11, and the stop 41 presses the blocking member 42 inward, whereby the firing pin 22 is displaced in the firing pin guide 12 to its rearward position, as shown in FIG. 3. In the position shown in FIG. 3, the cartridge chamber 18 abuts the firing pin guide 12 and is located in front of the opening 37. Thus, upon the completion of the press-on process, the piston guide 13 is supported opposite the firing pin 22 by the locking elements 31, 32 and through the locking elements 31, 32 and the firing pin 22 against the stop 43 formed by the locking element 33 and, thereby, against the housing 11.

Figure 4:
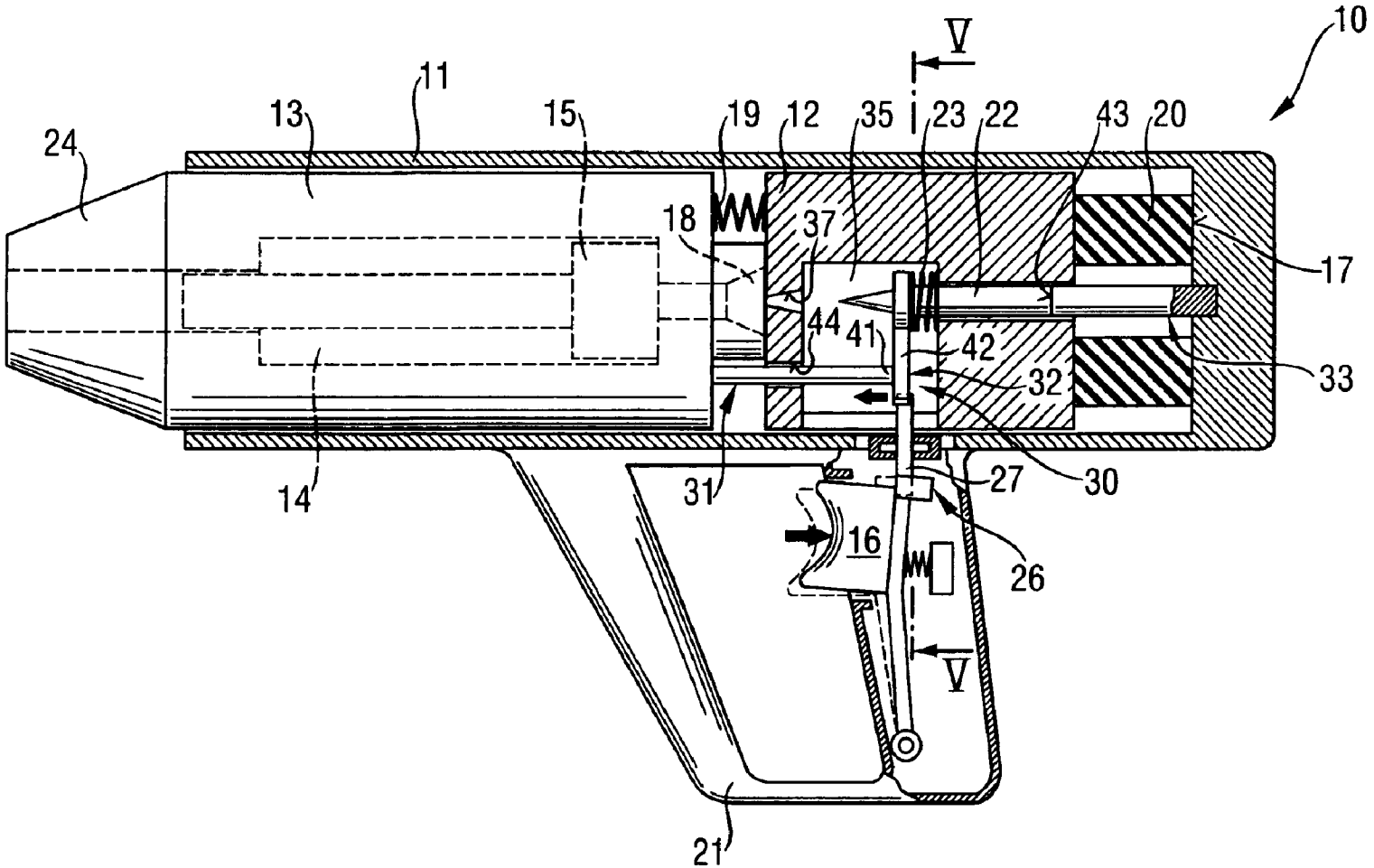
FIG. 4 a cross-sectional longitudinal view of the setting tool shown in FIG. 2 in its press-on position and with an actuated actuation switch.
Figure 5:
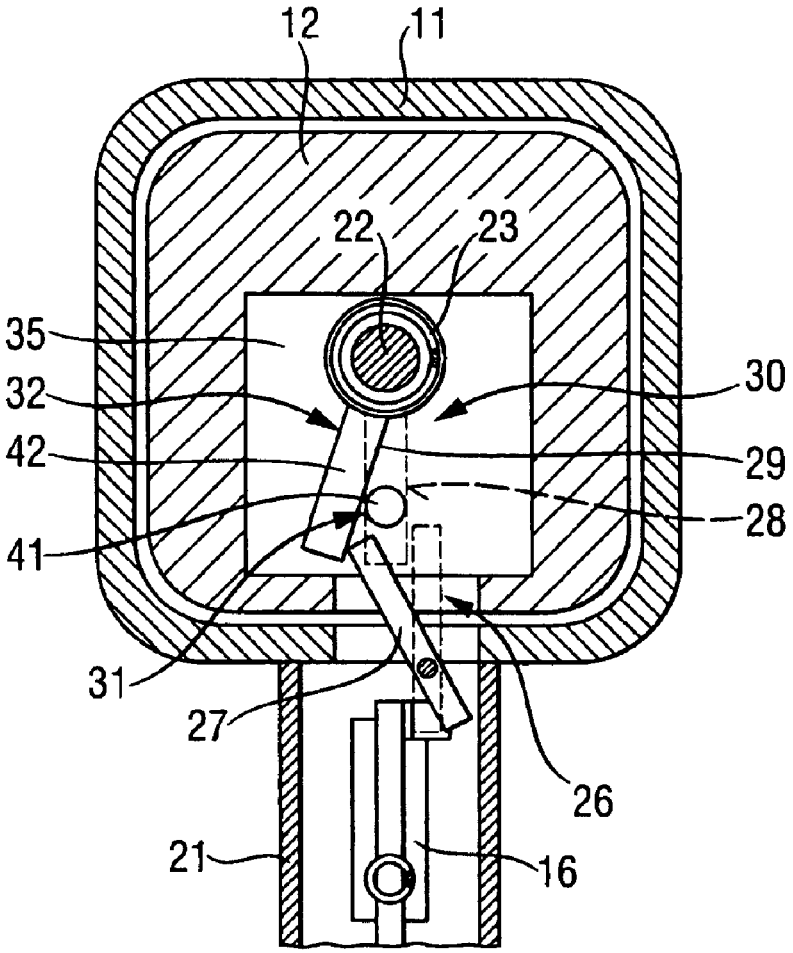
FIG. 5 a cross-sectional view of the setting tool shown in FIG. 4 along line V—V in FIG. 4.
Figure 6:
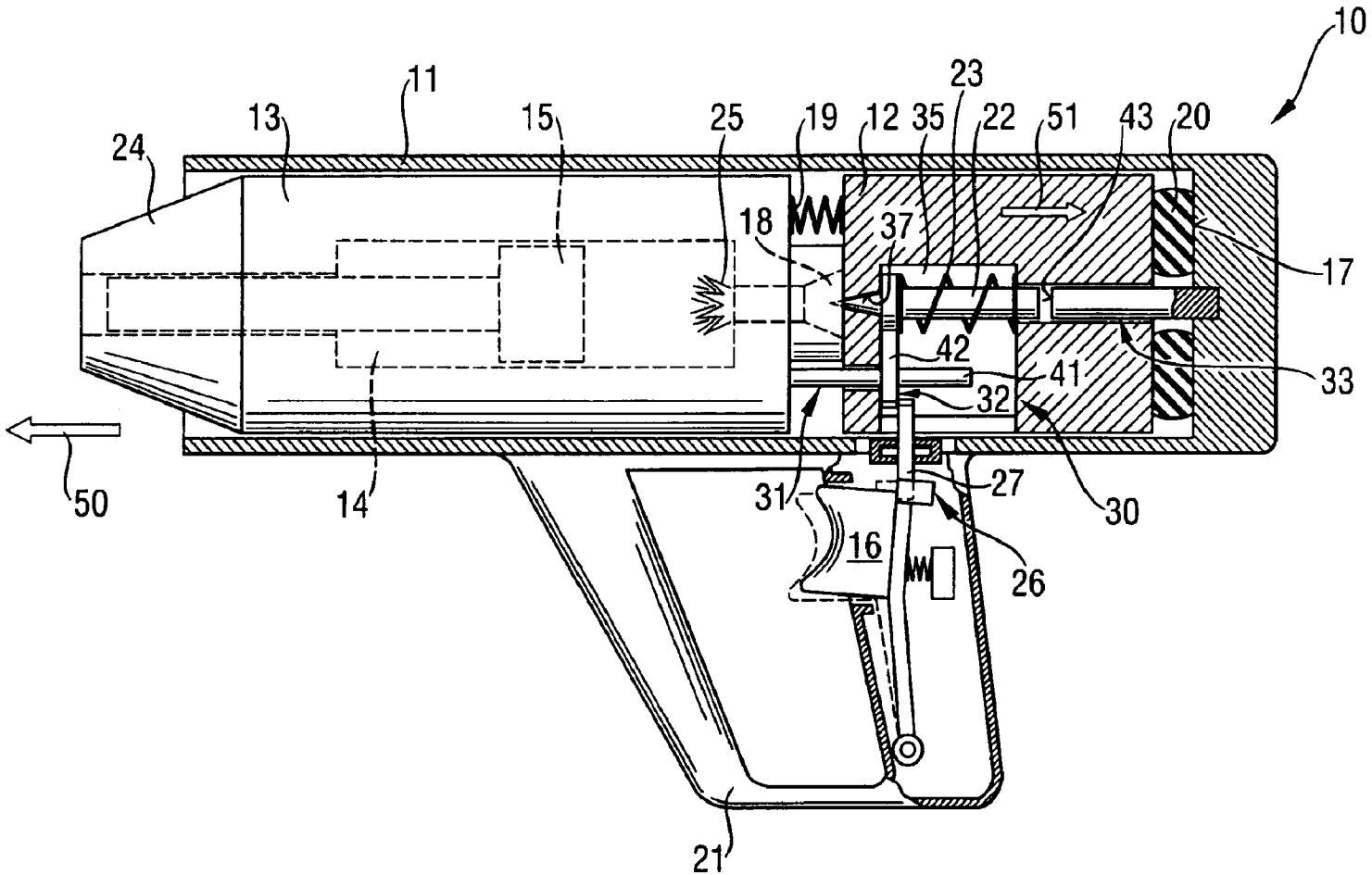
FIG. 6 a cross-sectional longitudinal view of the settling tool shown in FIG. 1 in its press-on condition after the ignition of the propellant charge.

FIGS. 4–5 show the position of the setting tool 10 upon actuation of the switch 16 that actuate switching means 26 which includes several levers and members. As it is particularly shown in FIG. 5, a switching lever 27 of the switching means 26 pivots the blocking member 42 away from the stop 41 so that the locking device 30 is displaced from its locking position 28 (shown with dash lines) to its release position 29. Upon the displacement of the locking device 30 into its release position, the firing pin 22, which is not retained any more in its rearward position by the stop 41, is advanced by the biasing force of the spring 23 forward, acting on a propellant (not shown), igniting the same, as shown in FIG. 6. The released gases 25, which are produced as a result of the combustion of the propellant, displace the drive piston in the setting direction 50. The front end of the drive piston impacts a fastening element (not shown) located in the bolt guide 24, driving the fastening element in a constructional component. The recoil force displaces the firing pin guide 12 and the piston guide 13 in the direction 51 into the interior of the housing 11, with the recoil pulls being damped by the damping element 20 which is not locked any more (see FIG. 6).

FIGS. 7–10 show a second embodiment of a setting tool according to the present invention. The setting tool 10 according to the second embodiment differs from the setting tool described with reference to FIGS. 1–6 by a different design of the firing pin guide 12, together with the firing pin 22, and of the locking device 30. The construction of the firing pin guide 12 and of the locking device 30 will be discussed in detail further below. The technical details of this embodiment, which corresponds to those of the setting tool described with reference to FIGS. 1–6, will be discussed by reference to the above-mentioned description of the first embodiment of the setting tool.

The firing pin guide 12 of the setting tool 10 according to the second embodiment differs from that of the setting tool according to the first embodiment in that the channel 36 has its rear end, i.e., the end facing the damping element 20, closed.

Further, a locking element 31 of the locking device 30, which forms a stop 141, is provided in the lower region of the firing pin guide 12 adjacent to the handle 21. The locking element 31 cooperates with the locking element 32 of the locking device 30 and which is formed as a lever-shaped blocking member 142. The blocking member 142 is arranged in the hosing 11 and is pivotally secured, at its housing-side end, on an axle 38. The blocking member 142 is engaged by a spring 39 that biases the blocking member 142 in direction 49, i.e., in the direction of its release position 29 (see FIG. 9). On the blocking member 142, there is provided a blocking nose 144 that engages in the locking position 28 of the locking device 30, the stop 141 which is provided on the firing pin guide 12. A reset element 34, which is provided on the piston guide 13, cooperates with the blocking member 142 and, in particular, with an inclination surface 45 provided on the blocking member 142. A precise function of the reset element 34 will be discussed further below.

Actuation means 26, which is actuated by the actuation switch 16, includes, in the embodiment of the setting tool shown in FIGS. 7–10, a lever 27 that, as shown in FIG. 7, supports the blocking member 142 in its blocking position 28, retaining the blocking member 142 in this position against the biasing force of the spring 39 until the actuation switch 16 is actuated.

In the embodiment of the setting tool 10 shown in FIGS. 7–10, the damping element 20 is formed as a solid, massive elastic element that is supported against a stop 17 provided in the housing 11. At its end opposite the stop 17, the damping element 20 abuts a rear surface of the firing pin guide 12.

Figure 9:
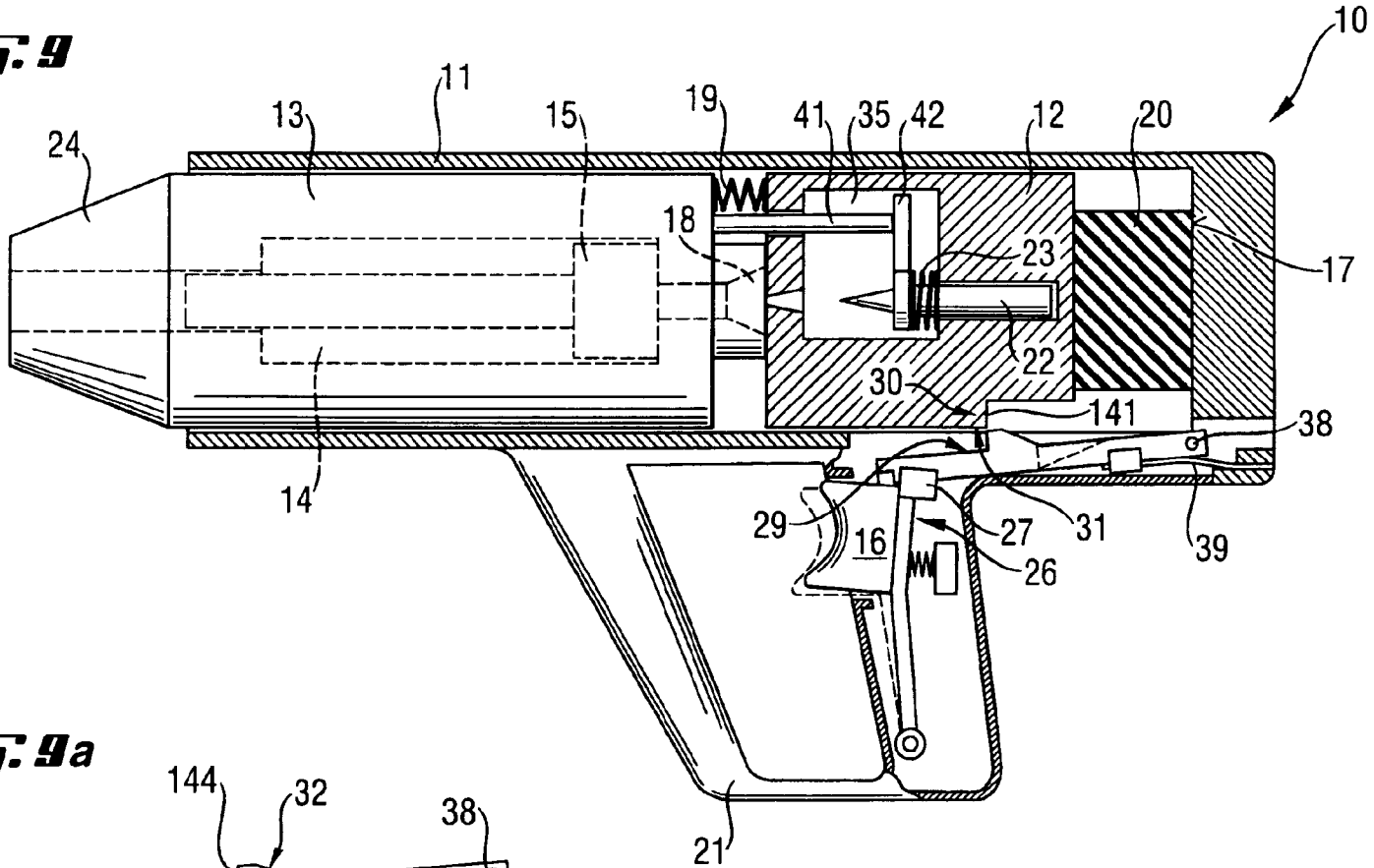
FIG. 9 a cross-sectional longitudinal view of the setting tool shown in FIG. 7 in its press-on position with an actuated actuation switch.
Figure 9A:
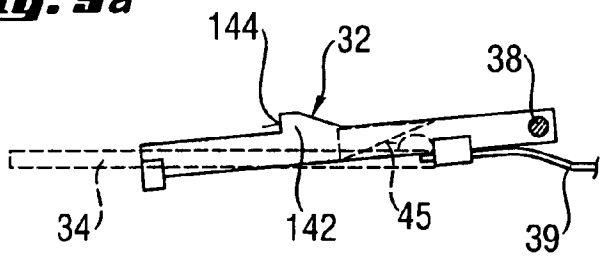
FIG. 9*a* a side view of a part of the locking device used in the tool shown in FIG. 9 in the actuated condition of the locking device.

As it has already been described above, in the locking position of the locking device 30, which is shown in FIG. 7, the blocking nose 144 of the locking element 32 or the blocking member 142 engages the stop 141 provided on the firing pin guide 12. When the setting tool 10 is pressed against a constructional component, the piston guide 13 is displaced in direction 51 into the interior of the housing 11, compressing the spring 19, The pin, which forms the stop 41, is displaced through the opening 44, which is formed in the firing pin guide 12, into the hollow chamber 35, displacing the blocking member 42, together with the firing pin 22 that is fixedly connected with the blocking member 42, to their rear position which is shown in FIG. 9. The displacement of the firing pin 22 rearwardly results in compression and preloading of the spring 23. As shown as the cartridge chamber 18 abuts the front end of the firing pin guide 12, further pressing of the setting of the setting tool 10 against the constructional component is not any more possible. This is because the locking device 30, which occupies its locking position 28, prevents the displacement rearwardly of the piston guide 13 and the firing pin guide 12 and, in particular, prevents the firing pin guide 12 from compressing the damping element 20.

Figures 1, 1A, 8:
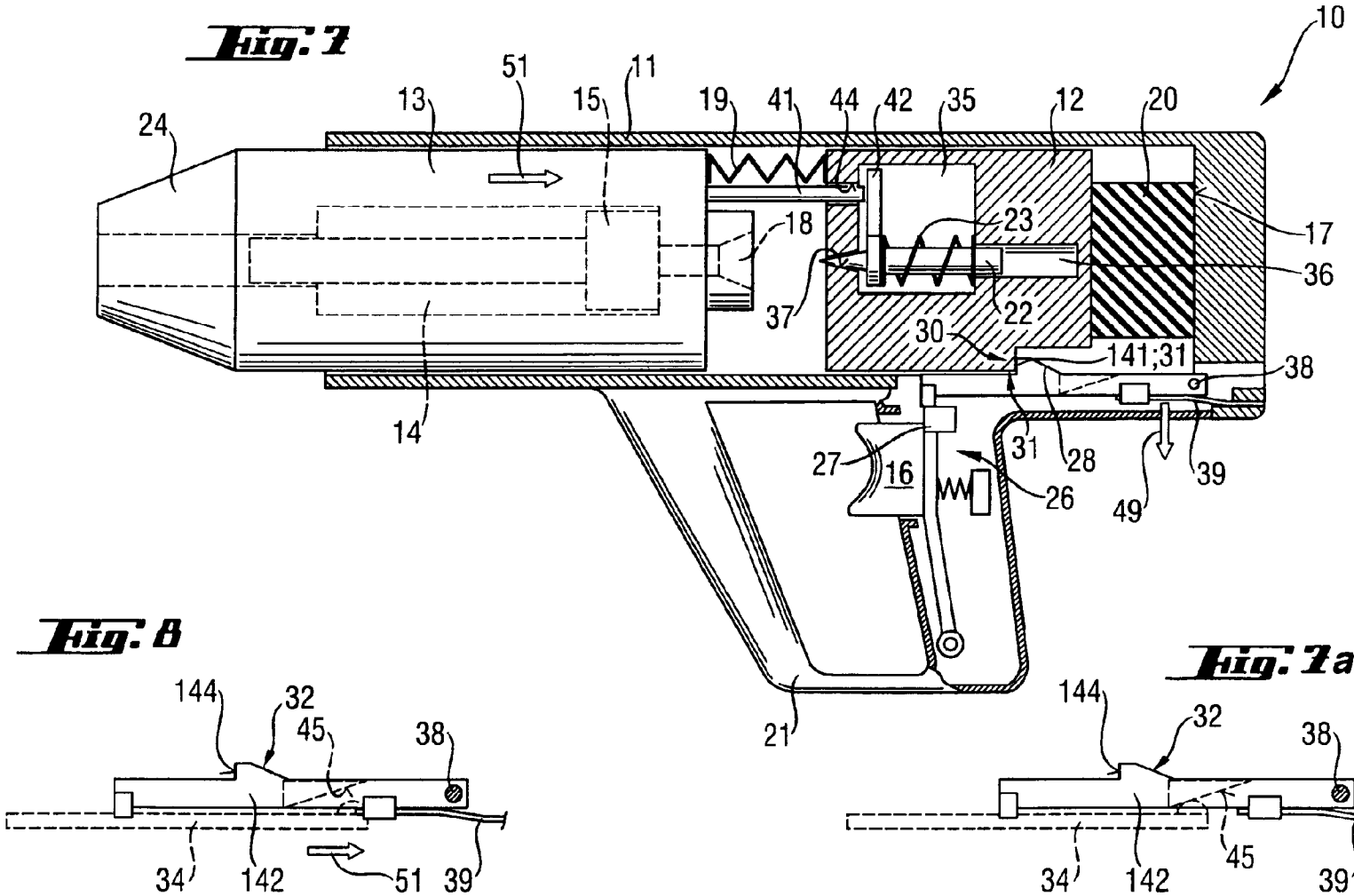
FIG. 8 a cross-sectional longitudinal view of the setting tool shown in FIG. 7 in its press-on position.

Further, when the setting tool 10 is pressed against a constructional component, the reset element 34 is also displaced with the piston guide 13 in the rearward direction 51, as shown in FIG. 8. Upon being displaced in the direction 51, the reset element 34 moves away from the inclination surface 45 that is formed on a cam provided on the blocking member 142. The displacement of the reset element 34 away from the inclination surface 45 allows for the pivotal movement of the blocking member 142.

Figure 10:
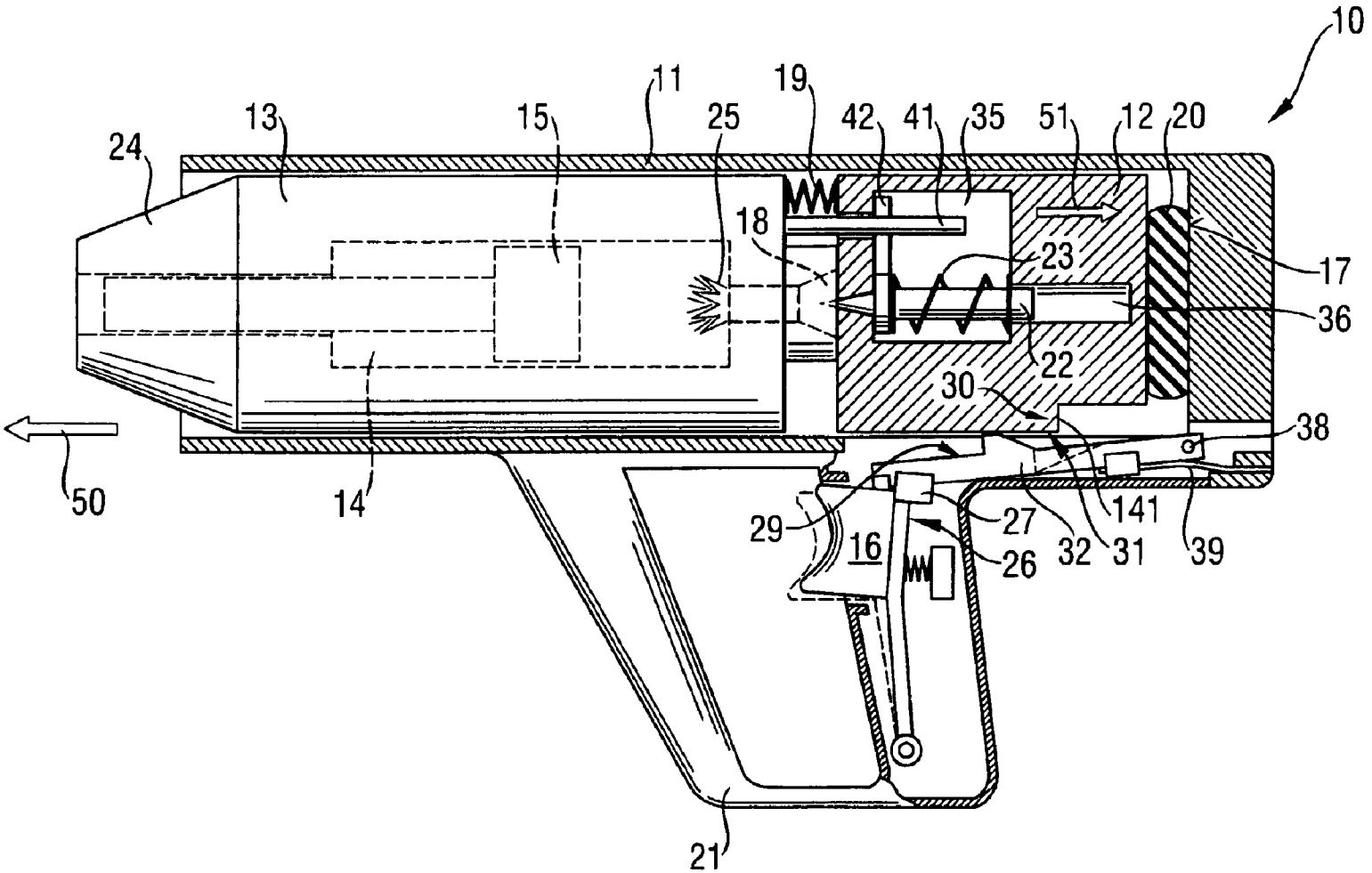
FIG. 10 a cross-sectional longitudinal view of the setting tool shown in FIG. 7 in its press-on condition after the ignition of the propellant charge.

Upon actuation of the switch 16, the switching means 26 is actuated, and the switching lever 27 pivots away from its support position beneath the front end of the blocking member 142, and the blocking member 142 pivots, under the biasing force of the spring 39, from its locking position 28 (shown in FIG. 7) to its release position 29 (shown in FIG. 9). Upon actuation of the switch 16, simultaneously, the switching means 26 pivots the blocking member 42, which is provided on the firing pin 22, a certain amount. As a result, the firing pin 22 is displaced in the setting direction 50 under the action of the spring 23, igniting propellant (not shown) located in the cartridge chamber 18, as shown in FIG. 10. A recoil pulse causes displacement of the piston guide 13 and the firing pin guide 12 in the direction 51 and against the damping element 20. The damping element 20 damps the recoil pulse, preventing the recoil force from acting, at least to a substantial degree, on the user of the setting tool 10.

When the setting tool 10 is lifted, after completion of the setting process, off the constructional component, the damping element 20 returns to its initial position, displacing the firing pin guide to its initial position. The piston guide 13 likewise returns into its initial position under the action of the spring 19. The reset element 34 is displaced in the setting direction 50, together with the piston guide 13, and moves along the inclination surface 45 provided on the blocking member 142, returning the blocking member 142 to its locking position 28 shown in FIG. 7.

Though the present invention was shown and described with references to the preferred embodiments such are merely illustrative of the present invention and are not to be construed as a limitation thereof and various modifications of the present invention will be apparent to those skilled in the art. It is, therefore, not intended that the present invention be limited to the disclosed embodiments or details thereof, and the present invention includes all variations and/or alternative embodiments within the spirit and scope of the present invention as defined by the appended claims.

What is claimed is:

1. A combustion-engined setting tool, comprising a housing (11); a piston guide (13) located in the housing (11) and axially displaceable relative thereto in a direction opposite a setting direction against a biasing force of spring means; a firing pin guide (12) provided on a side of the piston guide (13) facing in the direction opposite the setting direction and axially displaceable relative to the housing (11); damping means (20) supported against a stop (17) provided in the housing (11) and cooperating with the firing pin guide (12) for absorbing recoil forces during a setting process; and a locking device (30) having a locking position (28) in which it prevents a press-on force, which is generated upon the setting tool (10) being pressed against a construction component, from acting on the damping means (20), whereby the damping means (20) remains inactive during a press-on process, and having a release position (29) to which the locking device (30) is displaced upon actuation of a switch for actuating a setting process and in which the damping means (20) becomes active and is capable of absorbing the recoil forces.

2. A setting tool according to claim 1, wherein the locking device (30) comprises at least one first locking element (31) and at least one second locking element (32) which are provided between the housing (11) an the piston guide (13) and which are brought in a stop relationship with each other in the locking position (28) of the locking device (30) and are displaced relative to each other in the release position (29) of the locking device (30).

3. A setting tool according to claim 2, wherein the first locking element (31) forms a stop (41) mechanically fixedly secured on the piston guide (13), and the second locking element (32) is formed as a displaceable blocking member (42).

4. A setting tool according to claim 3, wherein the second locking member (32) is formed as a pivotal blocking member (42).

5. A setting tool according to claim 3, further comprising switch means for displacing the blocking member (42) from the locking position (28) in which the blocking member (42) engages the stop (41) formed by the first locking element (31), into the release position (29).

6. A setting tool according to claim 5, wherein the switch means includes an actuation switch (16).

7. A setting tool according to claim 3, wherein the blocking member (42) is provided on a firing pin (22).

8. A setting tool according to claim 1, wherein the locking device (30) comprises a third locking element (33) which is formed as a stop (43) fixedly secured the housing (11) and which the second locking element (32) engages in the locking position (28) of the locking device (30).

9. A setting tool according to claim 1, wherein the locking device (30) comprises a blocking member (142) pivotally supported in the housing (11), and a stop (141) provided on the firing pin guide (12), and wherein the blocking member (142) engages the stop (141) in the locking position (28) of the locking device (30) and is displaced from a movement path of the firing pin guide (12) and the stop (141) in the release position (29) of the locking device (30).

10. A setting tool according to claim 9 wherein the blocking member (142) is located behind the stop (141) in the locking position (28), and wherein the setting tool (10) has switch means for displacing the blocking member (142) from behind the stop (141).

11. A setting tool according to claim 10, wherein the switch means comprises an actuation switch.

12. A setting tool according to claim 9, further comprises a reset element (34) provided on the piston guide (12) for displacing the blocking member (142) into the locking position (28), in which the blocking member (142) is located behind the stop (141), upon lifting the setting tool (10) off the constructional component.

* * * * *